US008164248B2

(12) United States Patent
Yamazaki

(10) Patent No.: US 8,164,248 B2
(45) Date of Patent: Apr. 24, 2012

(54) IMAGE DISPLAY APPARATUS

(75) Inventor: Kouji Yamazaki, Ayase (JP)

(73) Assignee: Canon Kabushiki Kaisha, Tokyo (JP)

( * ) Notice: Subject to any disclaimer, the term of this patent is extended or adjusted under 35 U.S.C. 154(b) by 357 days.

(21) Appl. No.: 12/612,592

(22) Filed: Nov. 4, 2009

(65) Prior Publication Data

US 2010/0109507 A1 May 6, 2010

(30) Foreign Application Priority Data

Nov. 5, 2008 (JP) ..... 2008-284511

(51) Int. Cl.
*H01J 1/62* (2006.01)

(52) U.S. Cl. ..... 313/496

(58) Field of Classification Search ..... None
See application file for complete search history.

(56) References Cited

U.S. PATENT DOCUMENTS

2007/0210698 A1* 9/2007 Tanaka et al. ..... 313/496
2010/0156271 A1* 6/2010 Toyoguchi ..... 313/494

FOREIGN PATENT DOCUMENTS

EP 1638129 A2 3/2006
JP 2006-120622 A 5/2006

* cited by examiner

*Primary Examiner* — Ashok Patel
(74) *Attorney, Agent, or Firm* — Canon U.S.A., Inc., IP Division

(57) ABSTRACT

An image display apparatus includes a rear plate including electron emitting devices; a face plate including light emitting members, anode electrodes, partition members each disposed between adjacent light emitting members, and strip-shaped resistive members disposed on the partition members and connecting adjacent anode electrodes to one another; and a spacer disposed between the rear plate and the face plate, wherein the partition members include protrusions protruding so as to be closer to the rear plate than portions of the partition members on which the strip-shaped resistive members are disposed, and the spacer contacts the protrusions of the partition members.

5 Claims, 8 Drawing Sheets

IMAGE DISPLAY APPARATUS

BACKGROUND OF THE INVENTION

1. Field of the Invention

The present invention relates to an image display apparatus using electron beams, such as a field emission display (FED).

2. Description of the Related Art

Display apparatuses of a certain type display images by irradiating light emitting members with electrons emitted from electron emitting devices. In order to improve the brightness of such display apparatuses, it is desirable that electrons be sufficiently accelerated before the light emitting members are irradiated with the electrons. To do so, a high voltage has to be applied to anodes. However, since display apparatuses have become thinner in recent years, discharge may occur between the electron emitting devices and the anodes, which are disposed on a rear plate and on a face plate, respectively.

To prevent discharge, a display apparatus including anode electrodes and strip-shaped resistive members connecting adjacent anode electrodes to one another has been developed. In the display apparatus, when a discharge current flows, the resistive members connecting the anode electrodes to one another serve as current limiting resistors so as to suppress the discharge current. A display apparatus disclosed in Japanese Patent Laid-Open No. 2006-120622 (corresponding European Patent Laid-Open No. EP 1638129) includes strip-shaped resistive members disposed between light emitting members and a face plate, so that a discharge current is further reduced.

However, it is desirable to further improve the structure of the face plate disclosed in Japanese Patent Laid-Open No. 2006-120622 (corresponding European Patent Laid-Open No. EP 1638129) so as to increase the breakdown voltage between anode electrodes in a direction perpendicular to the direction in which the strip-shaped resistive members extend and more effectively use light emitted from the light emitting member.

SUMMARY OF THE INVENTION

The present invention provides a display apparatus that has a high breakdown voltage and is capable of performing high-brightness display. Moreover, degradation such as line defects is suppressed with the display apparatus.

According to the present invention, there is provided an image display apparatus including a rear plate including electron emitting devices; a face plate including light emitting members facing the electron emitting devices, the light emitting members emitting light by being irradiated with electrons, anode electrodes disposed on the light emitting members in an overlapping manner, partition members each disposed between adjacent light emitting members, the partition members protruding so as to be closer to the rear plate than the light emitting members, and strip-shaped resistive members disposed on portions of the partition members facing the rear plate, the strip-shaped resistive members connecting adjacent anode electrodes to one another; and a spacer disposed between the rear plate and the face plate in such a manner that the spacer intersects the strip-shaped resistive members, wherein the partition members include protrusions protruding so as to be closer to the rear plate than the portions of the partition members on which the strip-shaped resistive members are disposed, and the spacer contacts the protrusions of the partition members.

With the image display apparatus, the breakdown voltage between anode electrodes is increased. Moreover, the image display apparatus is capable of performing high-brightness display while effectively using light emitted from the light emitting members. Furthermore, break of the resistive members due to the spacer is prevented, whereby degradation of a displayed image such as line defects is more securely prevented.

Further features of the present invention will become apparent from the following description of exemplary embodiments with reference to the attached drawings.

DESCRIPTION OF THE EMBODIMENTS

Figure 1:
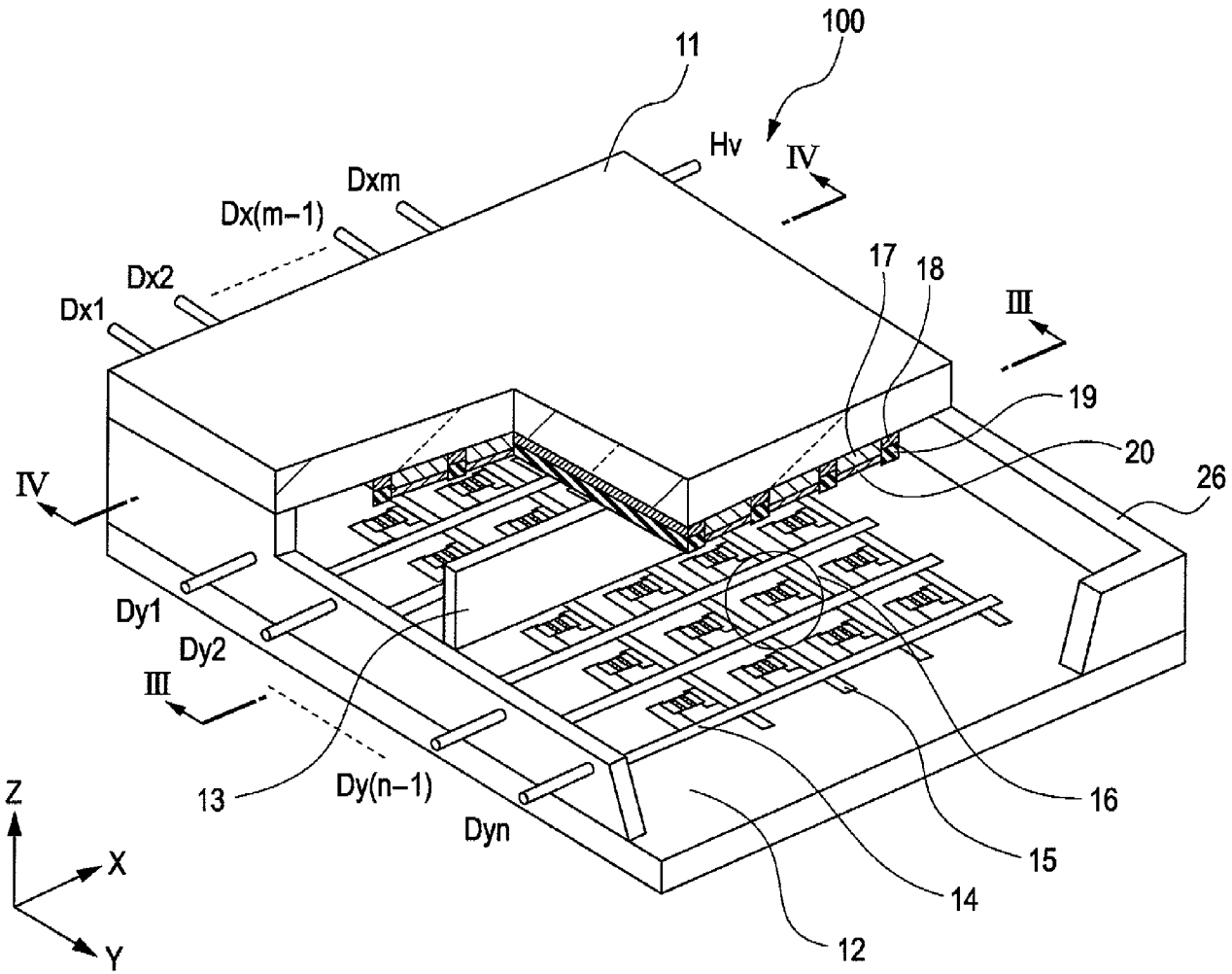
FIG. 1 is a perspective cutaway view illustrating an overall structure of an image display apparatus according to an embodiment of the present invention.
Figure 2A:
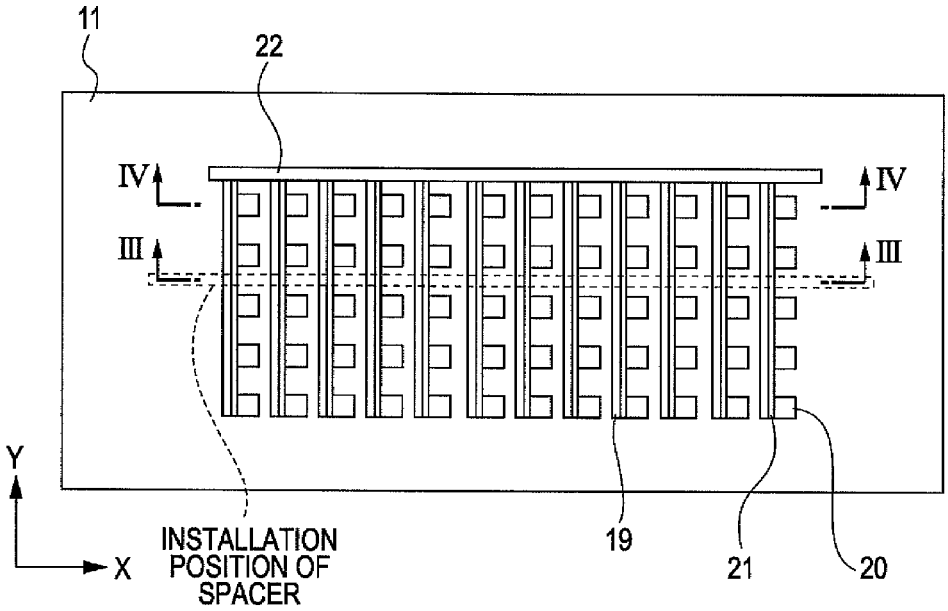
FIG. 2A is a plan view of a face plate of an embodiment of the present invention.
Figure 2B:
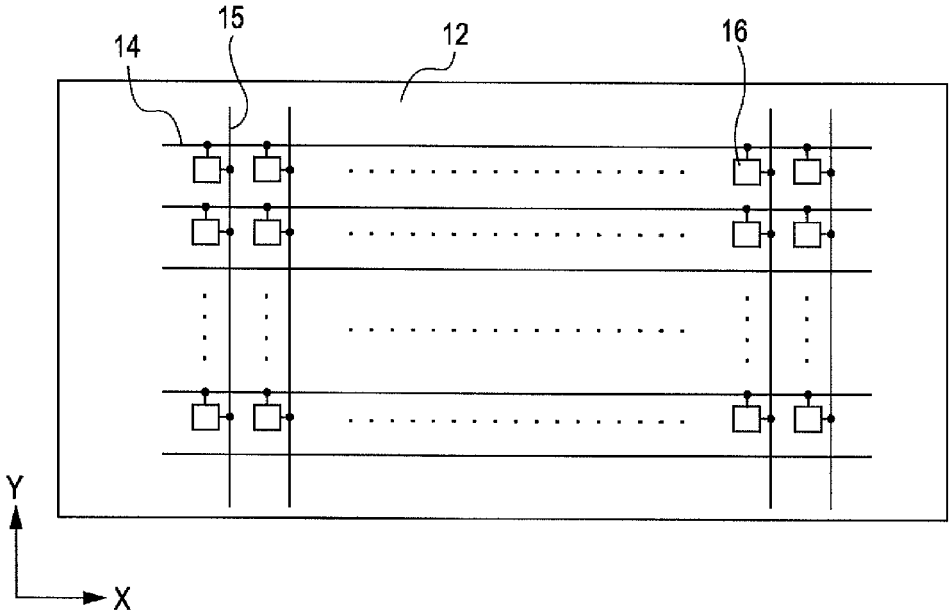
FIG. 2B is a plan view of a rear plate of an embodiment of the present invention.
Figure 3:
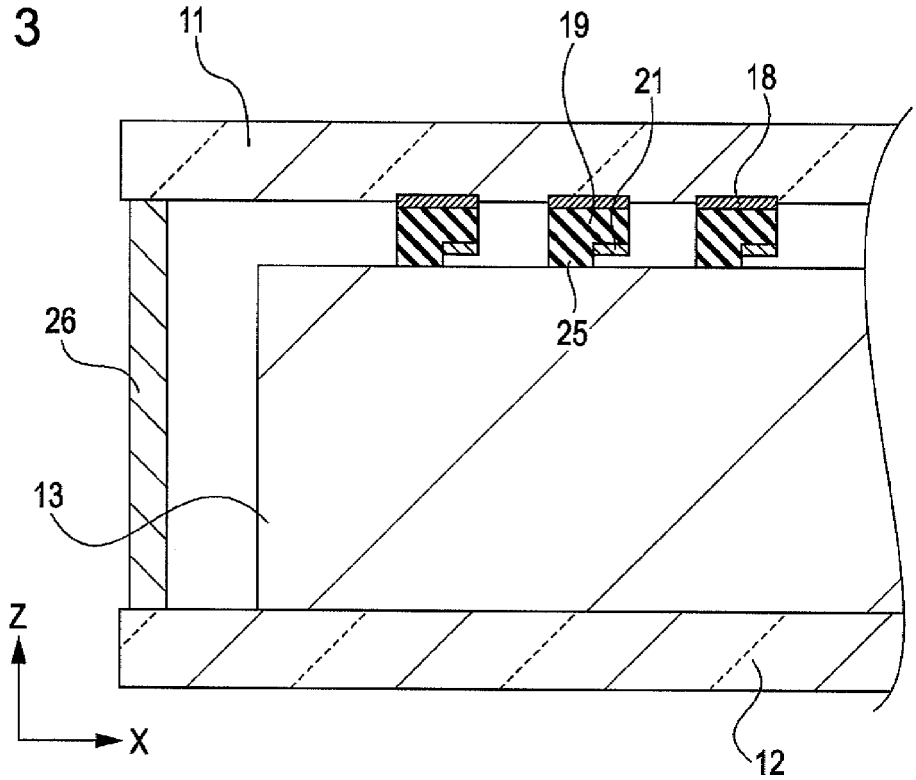
FIG. 3 is a partial sectional view of a first example of the image display apparatus.
Figure 4:
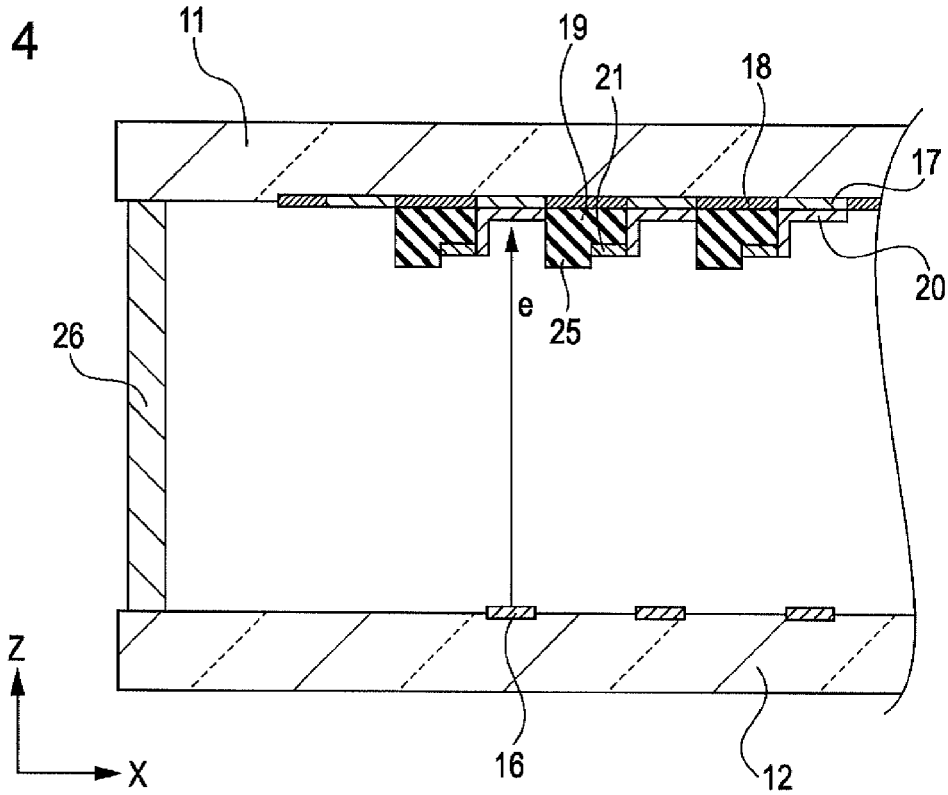
FIG. 4 is another partial sectional view of the first example of the image display apparatus.

Hereinafter, an embodiment of the present invention is described with reference to the drawings. FIG. 1 is a perspective cutaway view illustrating an overall structure of an image display apparatus 100 according to the embodiment of the present invention. FIG. 2A is a plan view of a face plate 11 of the image display apparatus 100 viewed from a rear plate 12. FIG. 2B is a plan view of the rear plate 12 viewed from the face plate 11. FIG. 3 is a sectional view taken along line III-III in FIG. 1. FIG. 4 is a sectional view taken along line IV-IV in FIG. 1. In order to clearly indicate positional relationships between the face plate and lines III-III and IV-IV in FIG. 1, the lines III-III and IV-IV are also drawn in FIG. 2A.

Electron-emitting devices 16 are disposed on the rear plate 12. As illustrated in FIG. 2B, in the present embodiment, the electron emitting devices 16 are connected to one another in a matrix pattern by scanning wiring lines 14 and information wiring lines 15.

Light emitting members 17 and anode electrodes 20 are disposed on the face plate 11. The light emitting members 17 emit light when being irradiated with electrons emitted from the electron emitting devices 16. The anode electrodes 20 are disposed on the light emitting members 17 in an overlapping manner. Partition members (rib) 19 are disposed between adjacent light emitting members 17. The partition members 19 protrude so as to be closer to the rear plate 12 than the light emitting members 17. Strip-shaped resistive members 21 are disposed on portions of the partition members 19 facing the rear plate 12. The strip-shaped resistive members 21 connect adjacent anode electrodes 20 to one another in the Y direction.

A spacer 13 is disposed between the rear plate 12 and the face plate 11. The spacer 13 is a protective structure that protects against atmospheric pressure. The spacer 13 is disposed between adjacent light emitting members 17 so that the spacer 13 may not affect an image displayed by the image display apparatus.

By disposing the partition members 19 between adjacent light emitting members 17 and by disposing the strip-shaped resistive members 21 on the portions of the partition members 19 facing the rear plate 12, the strip-shaped resistive members 21 do not obstruct light emitted from the light emitting members 17. Thus, light is effectively used, whereby the brightness of the image display apparatus is improved. Since the strip-shaped resistive members 21 connected to the anode electrodes 20 are located on the portions of the partition members 19 facing the rear plate 12, the anode electrodes 20 adjacent to one another in the X direction are securely insulated from one another. As a result, the breakdown voltage between the anode electrodes 20 adjacent to one another in the X direction is increased.

Since the spacer 13 is disposed between adjacent light emitting members 17, the spacer 13 may intersect and pressingly contact the strip-shaped resistive members 21, which are located on the portions of the partition members 19 facing the rear plate 12. In this case, portions of the strip-shaped resistive members 21 at which the strip-shaped resistive members 21 intersect the spacer 13 are subjected to a pressing force due to atmospheric pressure and a corresponding reaction force from the spacer 13. Therefore, the strip-shaped resistive members 21 may break at the portions. If the strip-shaped resistive members 21 break, feeding of power to the anode electrodes 20 is disabled, and strip-shaped non-emitting areas (line defects) may be formed along the strip-shaped resistive members 21 that have broken.

As illustrated in FIGS. 3 and 4, in the present embodiment, the partition members 19 have protrusions 25 in portions thereof on which the strip-shaped resistive members 21 are not disposed. The protrusions 25 protrude so as to be closer to the rear plate 12 than the portions on which the strip-shaped resistive members 21 are disposed. The spacer 13 contacts the protrusions 25 of the partition members 19. Thus, even if the spacer 13 is disposed between adjacent light emitting members 17 and the spacer 13 intersects the strip-shaped resistive members 21, a force applied to the strip-shaped resistive members 21 is reduced, since the spacer 13 contacts the protrusions 25 of the partition members 19. As a result, the spacer 13 can be disposed at an appropriate position between adjacent light emitting members 17 without causing the strip-shaped resistive members 21 to break, whereby the occurrence of line defects are suppressed. In the case that gaps are provided between the strip-shaped resistive members 21 and the spacer 13 as illustrated in FIG. 3, a force is not applied to the strip-shaped resistive members 21, so that the occurrence of line defects are more securely suppressed.

Materials of components of the present embodiment are described below in detail.

As the face plate 11, glass or other material that transmits visible light can be used. In the present embodiment, high strain point glass such as PD200 is preferably used.

As the anode electrodes 20, metal backs, which are made of aluminum or the like and used for CRT and other devices, can be used. Patterning of the anode electrodes 20 can be performed by vapor deposition using masks, etching, or the like. Since it is necessary that electrons pass through the anode electrodes 20 and reach the light emitting members 17, the thickness of the anode electrodes 20 is appropriately set by taking into account the energy loss of electrons, a predetermined acceleration voltage (anode voltage), and reflection efficiency of light. If a voltage in the range from 5 kV to 15 kV is to be applied to the anode electrodes 20, the thickness of the anode electrodes 20 is set in the range from 50 nm to 300 nm. If transparent electrodes made of ITO or the like are used as the anode electrodes 20, it is not necessary that the anode electrodes 20 cover the light emitting members 17 in an overlapping manner as illustrated in FIGS. 2A and 4. In this case, the anode electrodes 20 may be disposed between the face plate 11 and the light emitting members 17.

As the light emitting members 17, a crystal phosphor that emits light by using electron beam excitation can be used. Phosphors used for existing devices such as CRT, which are described, for example, in "Phosphor Handbook" (edited by the Phosphor Research Society and published by Ohmsha Ltd.) can be used. The thickness of the phosphor is appropriately set in accordance with an acceleration voltage, the particle diameter of the phosphor, and the packing density of the phosphor. If an acceleration voltage in the range from 5 kV to 15 kV is to be applied to the anode electrodes 20, the thickness of the phosphor is set in the range from 4.5 μm to 30 μm, which is 1.5 to 3 times larger than the average particle diameter of a general phosphor (which is in the range from 3 to 10 μm). It is preferable that the thickness of the phosphor be in the range from 5 to 15 μm.

Figure 5:
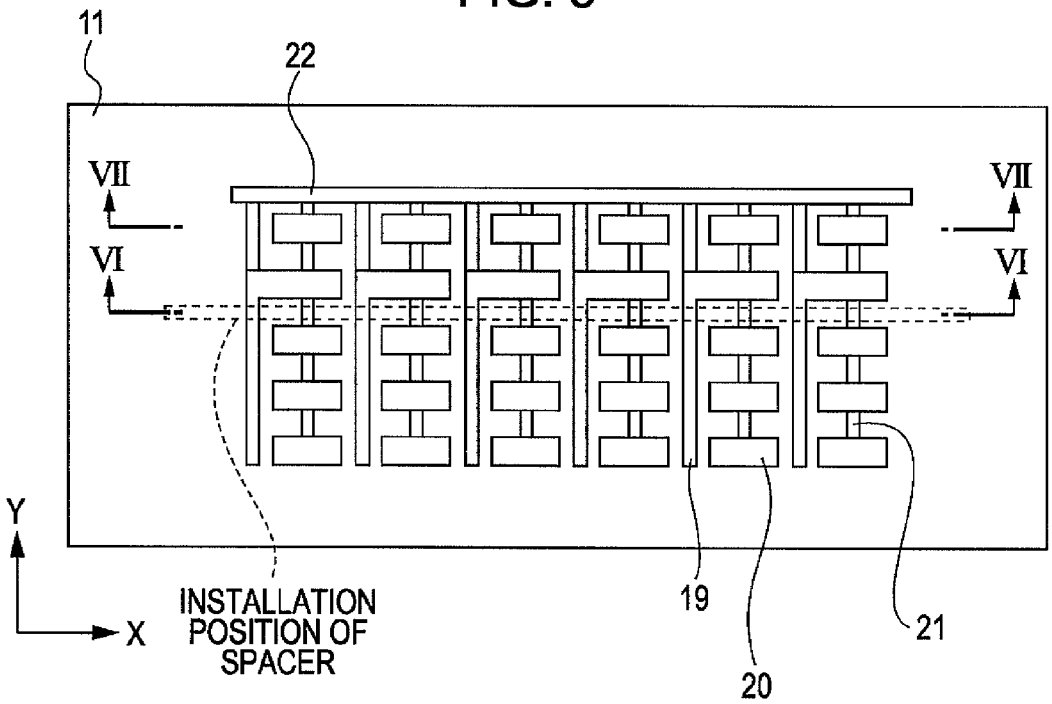
FIG. 5 illustrates a face plate of a third example.
Figure 10A:
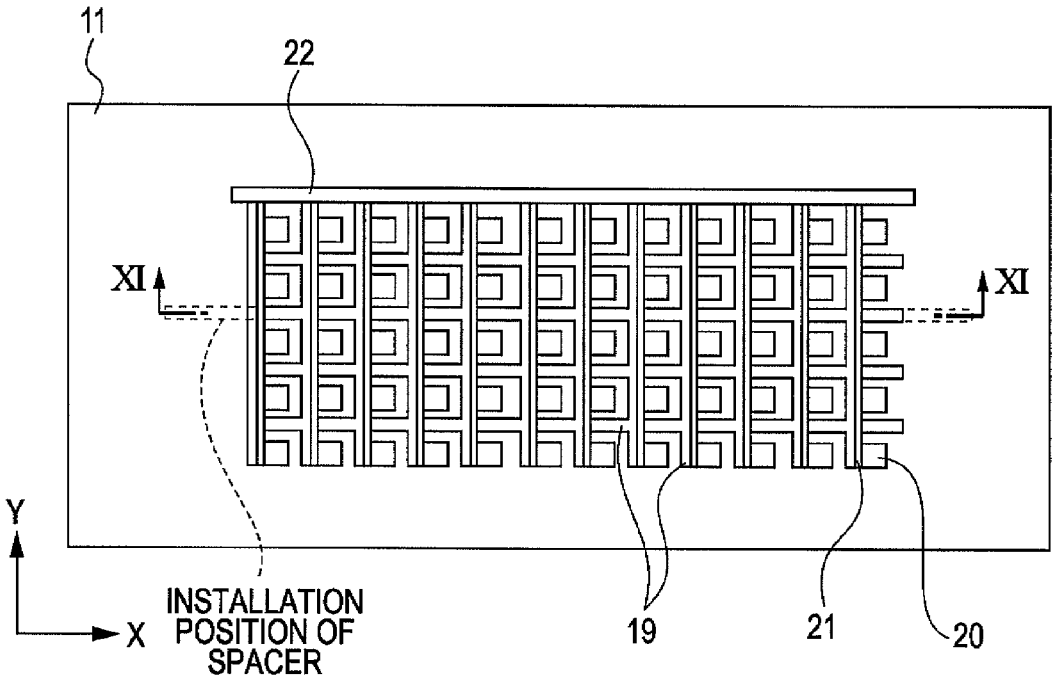
FIG. 10 is a plan view of a face plate including partition members having grid-like portions.
Figure 10B:
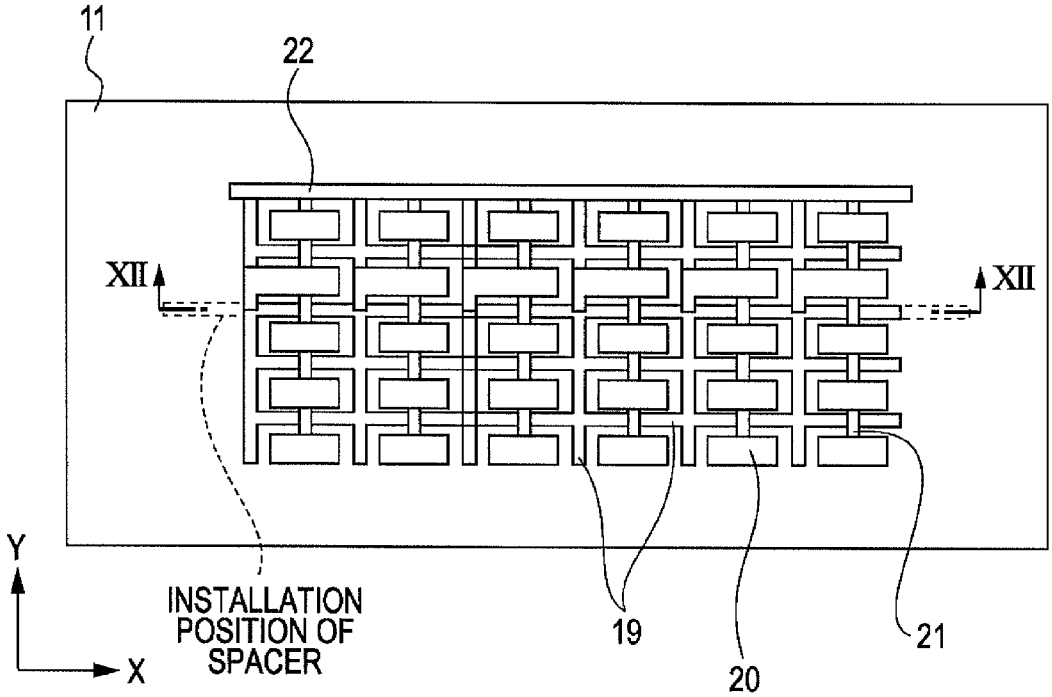
Figure 11:
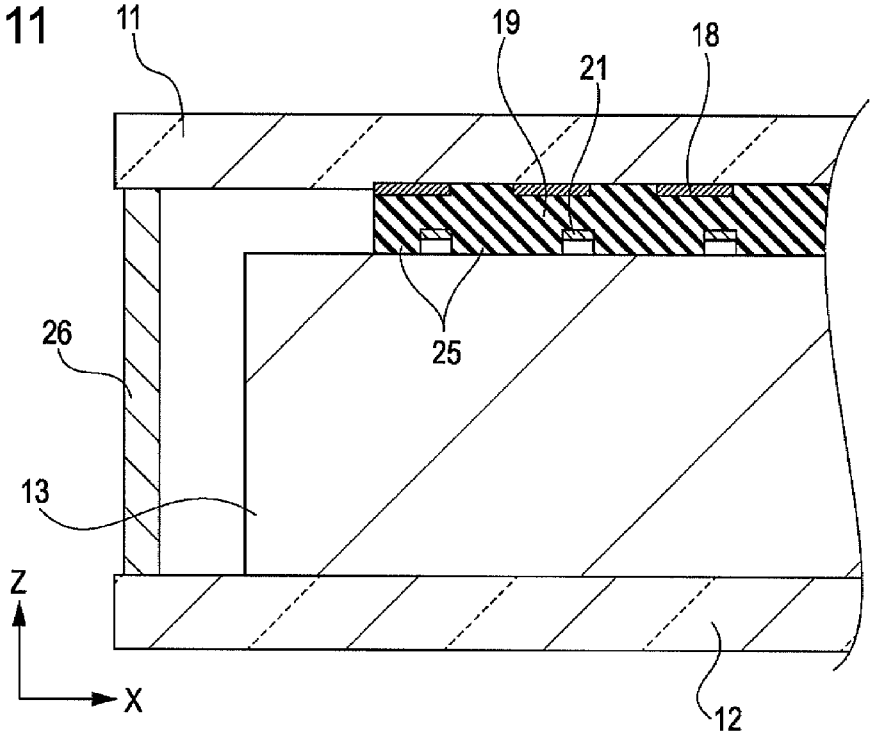
FIG. 11 is a partial sectional view of an image display apparatus using the face plate including partition members having grid-like portions.
Figure 12:
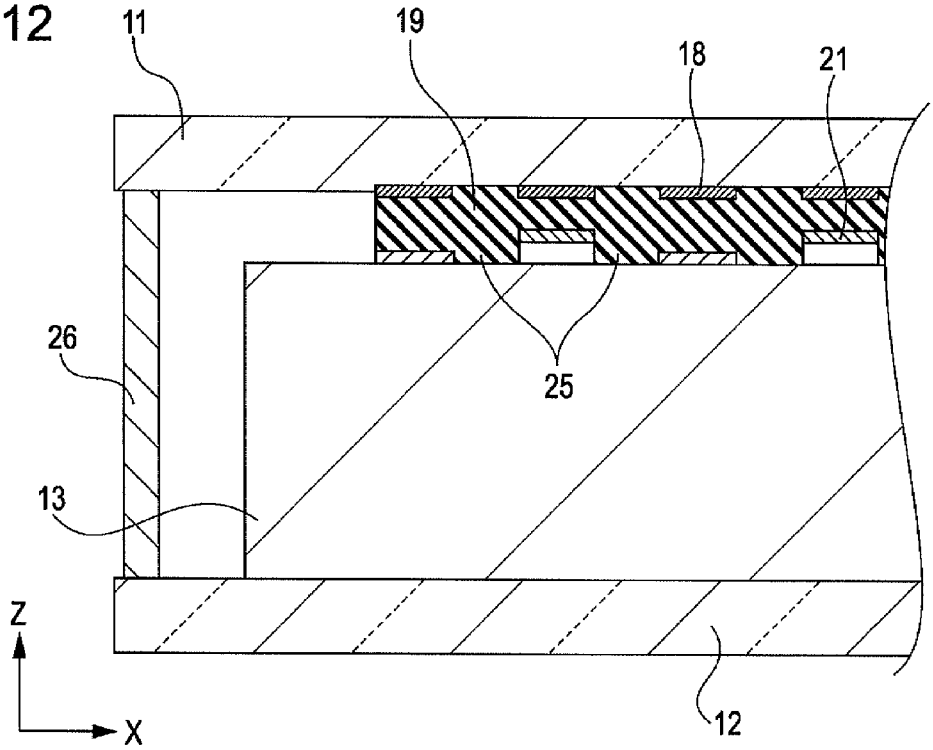
FIG. 12 is a partial sectional view of another image display apparatus using the face plate including partition members having grid-like portions.

It is preferable that the partition members 19 be made of an inorganic mixture having a high resistance close to insulation, such as a glass material including a metal oxide. Examples of the metal oxide include lead oxide, zinc oxide, bismuth oxide, boron oxide, aluminum oxide, silicon oxide, and titanium oxide. Patterning of the partition members 19 can be performed by sandblasting, application of a photosensitive paste, etching, or the like. The height of the partition members 19 is appropriately set in accordance with the specifications of the image display apparatus. It is preferable that the height of the partition members 19 be set in the range from 0.5 to 10 times larger than the width of the light emitting members 17 (the length in the X or Y direction). For example, if the width of one of the light emitting members 17 is 50 μm, it is preferable that the height of the partition members 19 be in the range from 25 μm to 500 μm. This setting serves to reduce so-called halation, which is a phenomenon that some of the light emitting members 17 emit light by being irradiated with electrons reflected by the other light emitting members 17. The partition members 19 are not limited to the members including strip shaped portions separated from one another as illustrated in FIGS. 2A and 5. As illustrated in FIGS. 10A and 10B, the partition members 19 may have grid-like portions. FIGS. 10A and 10B, which respectively correspond to FIG. 2A and FIG. 5, illustrate face plates having the partition members 19 including grid-like portions. It is preferable that the partition members 19 include grid-like portions, because halation as described above can be reduced in two directions (in the X and Y directions). FIG. 11 is a sectional view taken along line XI-XI of FIG. 10A, and FIG. 12 is a sectional view taken along line XII-XII of FIG. 10B. As described above, in the present invention, not only a face plate including the partition members 19 having strip-shaped portions separated from one another as illustrated in FIGS. 2A and 5, but also a face plate including the partition members 19 having grid-like portions as illustrated in FIGS. 10A and 10B can be used.

As the strip-shaped resistive members 21, resistors made of ruthenium oxide, ITO, or the like can be used. It is preferable that the resistance between adjacent light emitting members be in the range from 1 kΩ to 1 GΩ. Patterning of the strip-shaped resistive members 21 can be performed by an existing method such as printing or application using a dispenser. It is preferable that application using a dispenser be used so that recessed portions may be patterned.

As illustrated in FIGS. 2A and 3, the present embodiment includes a feeding electrode 22 to which all the strip-shaped resistive members 21 are electrically connected, and light-shielding members 18 disposed between the partition members 19 and the face plate 11.

A conductor such as a metal can used as the feeding electrode 22. In order to reduce voltage drop in the feeding electrode 22 when an acceleration voltage is applied from a high-voltage terminal Hv described below, it is preferable that the resistance between a connection portion of the feeding electrode 22 to which the high-voltage terminal Hv is connected and a portion of the feeding electrode 22 that is farthest from the connection portion be equal to or lower than 1 KΩ.

The light-shielding members 18 may be a known black-matrix structure used for CRT and the like, which is typically made of a black metal, a black metal oxide, carbon, or the like. Examples of the black metal oxide include ruthenium oxide, chromium oxide, iron oxide, nickel oxide, molybdenum oxide, cobalt oxide, and copper oxide.

Next, the rear plate 12 is described. As illustrated in FIGS. 1 and 2B, the electron emitting devices 16 for exciting the light emitting members 17 to emit light are disposed on an inner surface of the rear plate 12. For the electron emitting devices 16, for example, surface-conduction electron emitting devices are suitable. On the inner surface of the rear plate 12, the scanning wiring lines 14 and the information wiring lines 15 for supplying driving voltage to the electron emitting devices 16 are disposed.

The spacer 13 is made of an insulator such as glass or a composite of an insulator and a conductor. Alternatively, a surface of the spacer 13 may be covered with a resistive member. If the spacer 13 has a slight conductivity (hereinafter referred to as a conductive spacer), it is preferable that the protrusions 25 of the partition members 19 be covered with the anode electrodes 20 and the conductive spacer contact the protrusions 25 of the partition member via the anode electrodes 20 so as to prevent the spacer from being charged. Thus, the path of electrons emitted from the electron emitting devices becomes stable, whereby an excellent image can be displayed.

The image display apparatus 100 is formed by disposing the spacer 13 between the face plate 11 and the rear plate 12 and by joining the peripheral portions of the face plate 11 and the rear plate 12 to each other via a side wall 26.

In order to make the image display apparatus 100 display an image, a voltage is applied to the anode electrodes 20 from the high-voltage terminal Hv through the strip-shaped resistive members 21. At the same time, driving voltage is applied to the electron emitting devices 16 from terminals Dy and Dx through the scanning wiring lines 14 and the information wiring lines 15, thereby making desired electron emitting devices 16 emit electron beams. The electron beams emitted from the electron emitting devices are accelerated and collide with the light emitting members 17. Thus, the light emitting members 17 are selectively excited so as to emit light, whereby an image is displayed.

EXAMPLES

First Example

A first example of the present invention is described. Since the overall structure of the rear plate and the image display apparatus are described above, only the characteristics of the first example are described. FIG. 2A illustrates the face plate 11 of the first example viewed from the rear plate. FIGS. 3 and 4 are sectional views taken along lines III-III and IV-IV of FIG. 2A (or FIG. 1), respectively.

The face plate 11 of the first example was made as described below.

(Step 1) A surface of a glass substrate was cleaned, strips of black paste (NP-7803D, made by Noritake Co., Ltd.) extending in the Y direction was screen printed on the surface with a width of 60 μm, and the glass substrate was dried at 120° C. and fired at 550° C., so that the light-shielding members 18 having a thickness of 5 μm was formed. The intervals (gaps) between the light-shielding members 18 in the X direction were 90 μm. The pitch of the light-shielding members 18 in the X direction was 150 μm, which was the same as the pitch of the electron emitting devices on the rear plate.

(Step 2) A bismuth oxide base insulating paste (NP7753, made by Noritake Co., Ltd.) was applied to the light-shielding members 18 using a slit coater such that the paste had a layer thickness of 190 μm after being fired, and the glass substrate was dried for ten minutes at 120° C., so that preforms of partition members were formed.

(Step 3) Dry film resist (DFR) was laminated on the preforms of the partition members using a laminator. A chromium mask for exposing the DFR was aligned in a predetermined position and the DFR was exposed in a pattern. The chromium mask had a shape such that the chromium mask masked (so as not to expose) strip-shaped portions, each having a width of 40 μm, corresponding to the portions on which the strip-shaped resistive members 21 were to be disposed in the following step. The DFR was exposed using the chromium mask. The DFR was developed using developer (unexposed portions were removed), rinsed, and dried, so that a mask made of the DFR having openings in desired positions for sandblasting was formed. By performing sandblasting using abrasives such as stainless steel particles, unnecessary portions corresponding to the openings of the DFR were removed from the preforms of the partition members by a depth of 15 μm, so that depressions for disposing strip-shaped resistors therein were formed.

(Step 4) As with the case when the depressions were formed, lamination of DFR, exposure, and development (removal of unexposed portions) were performed on the preforms of the partition members having the depressions therein, so that a sandblasting mask made of DFR having a desired pattern was formed. The DFR (masked portions for sandblasting) was formed in a pattern having stripes each having a width of 50 μm so as to overlap the light-shielding members 18. The preforms of the partition members were sandblasted using abrasive of stainless steel particles so as to remove unnecessary portions using openings of the DFR, so that the preforms were patterned in a stripe pattern. Subsequently, the DFR was stripped using a resist stripper shower, and the substrate was cleaned.

(Step 5) On the depressions of the preforms of the partition members having been thus patterned, a resistance paste including ruthenium oxide was formed using a dispenser such that the paste had a layer thickness of 5 μm after being fired, and the substrate was dried for ten minutes at 120° C. The volume resistivity of the high resistance paste, which was measured by applying the paste to a test pattern, was $10^{-1}$ Ω·m.

(Step 6) The substrate was fired at 530° C., so that the partition members 19, which included strip-shaped portions having protrusions 25, and the strip-shaped resistive members 21 were formed. The height of the partition members 19 at the protrusions 25 was larger than the sum of the height of the portions of partition members 19 on which the strip-shaped resistive members 21 are disposed and the height of the strip-shaped resistive members 21 by 10 μm.

(Step 7) As the material of the light emitting members 17, by using a paste dispersed with P22 phosphor used for CRT, the phosphor was printed by a screen printing method to be aligned with the partition members 19 having strip-shaped openings. In the present example, phosphors for red, green, blue were applied in strip shapes so as to make a color display. The phosphors had a layer thickness of 15 μm. Subsequently, the phosphors for the three colors were dried at 120° C. The phosphors may be dried color by color or simultaneously. Moreover, alkaline silicate, which is an aqueous solution including so-called water glass and serves as a binder, was sprayed on the phosphors.

(Step 8) Acrylic emulsion was applied by spray coating, dried, spaces among phosphor powders was filled with acrylic resin, and an aluminum layer to become the anode electrodes 20 was deposited on the phosphors. At this time, the anode electrodes 20 was formed by using a metal mask having openings in portions corresponding to the phosphors, which were the light emitting members 17, and in portions corresponding to the strip-shaped resistive members 21. The thickness of the aluminum layer to become the anode electrodes 20 was 100 nm.

The material of the anode electrodes 20 is not limited to aluminum, and may be titanium, or chromium.

Using the face plate 11 made as described above, the image display apparatus 100 illustrated in FIG. 1 was made. As illustrated in FIG. 3, the spacer 13 contacted the protrusions 25 of the partition members 19. Gaps having a width of about 10 μm were formed between the spacer 13 and the strip-shaped resistive members 21. (In other words, the spacer 13 was separated from the strip-shaped resistive members 21 by about 10 μm.)

A voltage of 8 kV was applied to the anode electrodes 20 through the strip-shaped resistive members 21 so as to make the image display apparatus 100 display an image. An excellent image having sufficient brightness without color mixture due to halation was displayed. Line defects along the strip-shaped resistive members 21 did not occur.

An excessive voltage was applied to specified electron emitting devices 16 so as to break electron emitting devices and cause discharge between the electron emitting devices and the face plate 11. It was observed that the scale of discharge was sufficiently small, so that devices other than the specified electron emitting devices were not damaged.

The image display apparatus 100 of the first example was disassembled so as to observe the inside of the face plate 11. It was observed that the portions of the strip-shaped resistive members 21 intersecting the spacer 3 had not been broken.

Second Example

Figure 8:
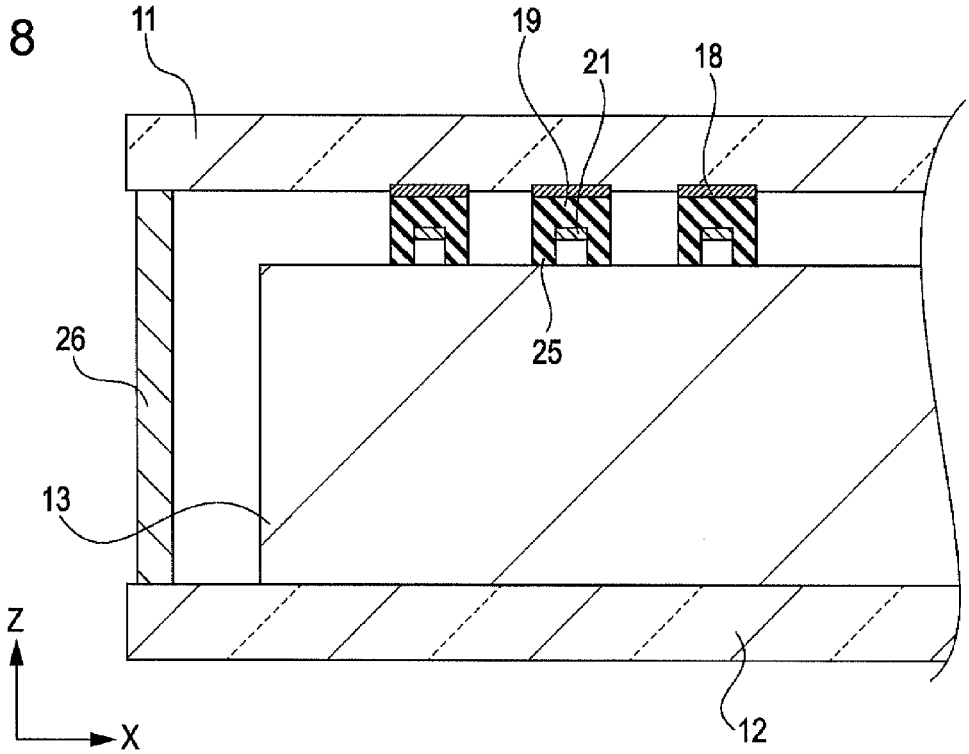
FIG. 8 is a partial sectional view of the second example of the image display apparatus.
Figure 9:
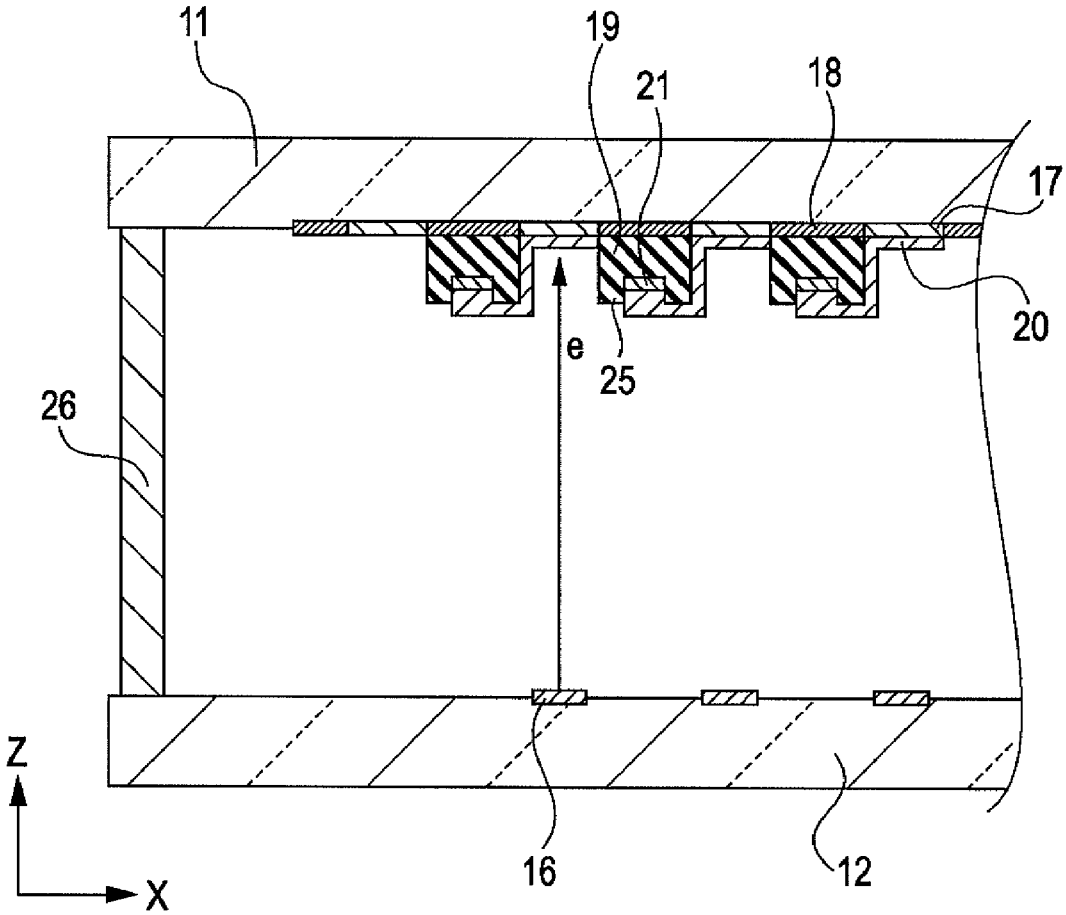
FIG. 9 is another partial sectional view of the second example of the image display apparatus.

A second example of the present invention is described. The basic structure of the second example is the same as that of the first example. The first and second examples differ in that a face plate illustrated in FIGS. 8 and 9 was used in the second example.

Advantages similar to those of the first example were gained with the second example. The portions of the strip-shaped resistive members 21 at which strip-shaped resistive members 21 were connected to the anode electrodes 20 were covered with the anode electrodes 20. Thus, the anode electrodes 20 were electrically connected to the strip-shaped resistive members 21 more securely, so that the voltage of the anode electrodes becomes stable and a more excellent image was displayed.

Third Example

A third example of the present invention is described. The basic structure of the third example is the same as that of the first example. The first and third examples differ in that, in the third example, a face plate illustrated in FIGS. 5 to 7 was used and a conductive spacer was used as the spacer 13.

A method of making the face plate 11 used in the third example is described.

Steps 1, 2, and 4 of the first example were performed in the third example. Step 3 was not performed. Subsequent to step 4, the following steps 5-1 and 5-2 were performed.

(Step 5-1) On the preforms of the partition members having been thus patterned, a high-resistant paste including ruthenium oxide was applied to alternate columns in the X direction in FIG. 5 (even number columns in FIG. 5) such that the paste had a layer thickness of 5 μm using a dispenser, and the preforms were dried for ten minutes at 120° C. The volume resistivity of the high resistance paste, which was measured by applying the paste to a test pattern, was $10^{-1}$ Ω·m.

(Step 5-2) To the preforms of the partition members to which the high resistance paste including ruthenium oxide had not been applied in step 5-1 (odd number columns in FIG. 5), an insulating paste used in step 2 was applied by screen printing such that the paste had a layer thickness of 15 μm after being fired, and the preforms were dried, so that preforms of protrusions was formed.

A step similar to step 6 in the first example was performed so as to form the partition members 19 including strip-shaped portions. Thus, among the strip-shaped portions of the partition members 19 of third example, only a part of the strip-shaped portions (odd number columns) had the protrusions 25. Subsequently, steps similar to steps 7 and 8 of the first example were performed so as to make the face plate 11 of the third example, and the image display apparatus 100 was made using the face plate 11.

Figure 6:
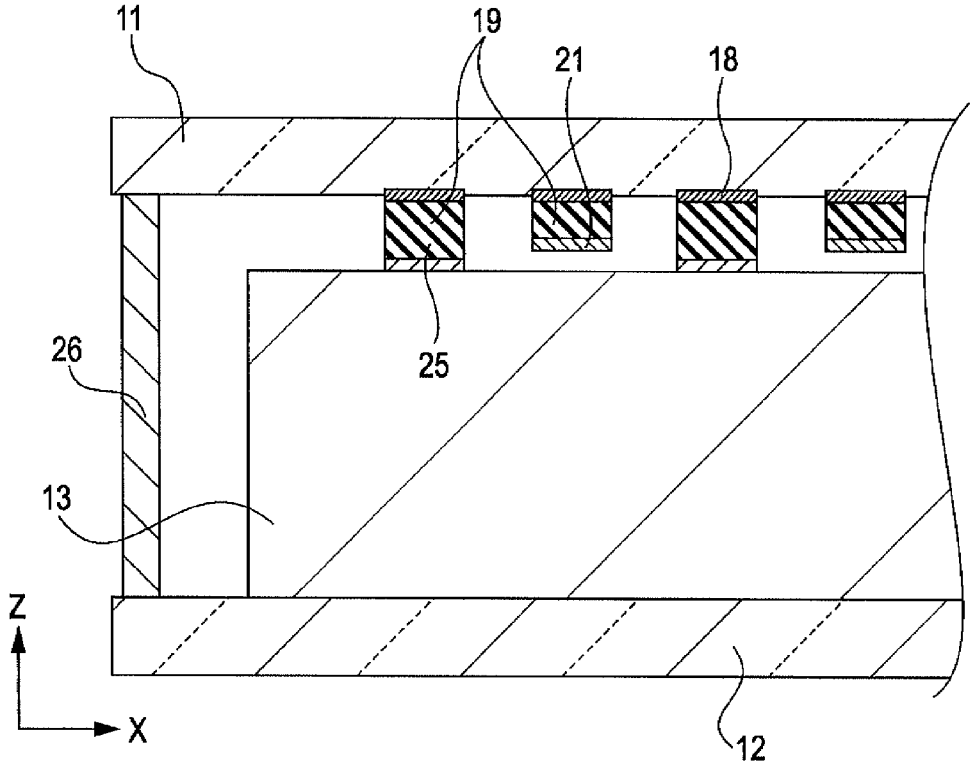
FIG. 6 is a partial sectional view of the third example of the image display apparatus.
Figure 7:
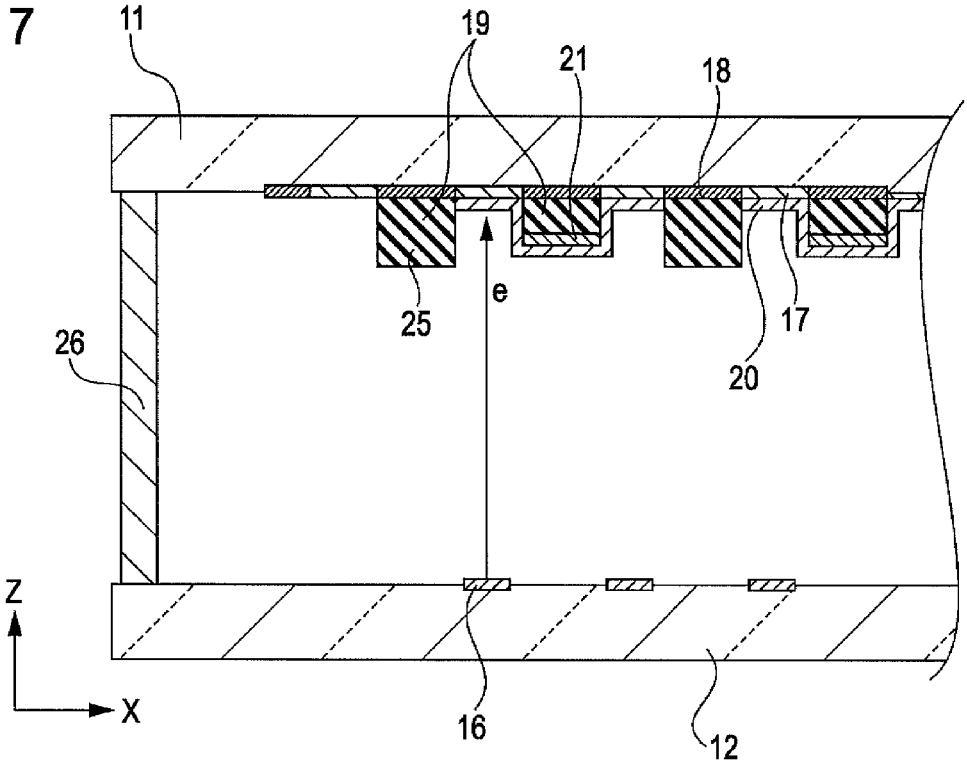
FIG. 7 is another partial sectional view of the third example of the image display apparatus.

As illustrated in FIG. 6, in the image display apparatus 100 of the third example, the spacer 13 contacts the protrusions 25 of the partition members 19. Gaps of about 10 μm are formed between the spacer 13 and the strip-shaped resistive members 21. (In other words, the spacer 13 was separated from the strip-shaped resistive members 21 by about 10 μm.)

A voltage of 8 kV was applied to the anode electrodes 20 through the strip-shaped resistive members 21 so as to make the image display apparatus 100 display an image. An excellent image having sufficient brightness without color mixture due to halation was displayed. Line defects along the strip-shaped resistive members 21 did not occur.

An excessive voltage was applied to specified electron emitting devices 16 so as to break the specified electron emitting devices and cause discharge between the specified electron emitting devices and the face plate 11. It was observed that the scale of discharge was sufficiently small, so that devices other than the specified electron emitting devices were not damaged.

The image display apparatus 100 of the first example was disassembled so as to observe the inside of the face plate 11. It was observed that the portions of the strip-shaped resistive members 21 intersecting the spacer 3 had not been broken.

In the third example, as with the second example, the portions of the strip-shaped resistive members 21 at which strip-shaped resistive members 21 were connected to the anode electrodes 20 were covered with the anode electrodes 20. Thus, the anode electrodes 20 were electrically connected to the strip-shaped resistive members 21 more securely, so that the voltage of the anode electrodes becomes stable and a more excellent image was displayed. Moreover, in the third example, a conductive spacer was used as the spacer 13, the protrusions 25 of the partition members 19 in contact with the spacer 13 were covered with the anode electrodes 20, and the spacer was in contact with the protrusions 25 of the partition members 19 via the anode electrodes 20. Thus, the spacer 13 was prevented from being charged, so that a more excellent image than the first example was displayed.

Heretofore, examples of the present invention have been described. In the present invention, the examples may be used in combination as appropriate. For example, in the first and second examples, as in the third example, a conductive spacer may be used as the spacer 13, the protrusions of the partition members 19 may be covered with the anode electrodes 20, and the conductive spacer may contact the protrusions 25 of the partition members 19 via the anode electrodes. In this case, as with the third example, a more excellent image display is obtained.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-284511 filed Nov. 5, 2008, which is hereby incorporated by reference herein in its entirety.

What is claimed is:

1. An image display apparatus comprising:

a rear plate including electron emitting devices;

a face plate including light emitting members facing the electron emitting devices, the light emitting members emitting light by being irradiated with electrons, anode electrodes disposed on the light emitting members in an overlapping manner, partition members each disposed between adjacent light emitting members, the partition members protruding so as to be closer to the rear plate than the light emitting members, and strip-shaped resistive members disposed on portions of the partition members facing the rear plate, the strip-shaped resistive members connecting adjacent anode electrodes to one another; and a spacer disposed between the rear plate and the face plate in such a manner that the spacer intersects the strip-shaped resistive members, wherein the partition members include protrusions protruding so as to be closer to the rear plate than the portions of the partition members on which the strip-shaped resistive members are disposed, and the spacer contacts the protrusions of the partition members.

2. The image display apparatus according to claim 1, wherein gaps are formed between the spacer and the strip-shaped resistive members.

3. The image display apparatus according to claim 1, wherein the strip-shaped resistive members are covered with the anode electrodes.

4. The image display apparatus according to claim 1, wherein the partition members include strip-shaped portions, a part of the strip-shaped portions including the protrusions.

5. The image display apparatus according to claim 1, wherein the protrusions of the partition members are covered with the anode electrodes, and the spacer contacts the protrusions of the partition members with the anode electrodes therebetween.

* * * * *